United States Patent [19]

Wright et al.

[11] 4,277,330

[45] Jul. 7, 1981

[54] SPIRAL SEPARATORS

[75] Inventors: Douglas C. Wright, Terranora; Sidney N. Roberts, Banora Point, both of Australia

[73] Assignee: Inheed Pty. Ltd., New South Wales, Australia

[21] Appl. No.: 116,629

[22] Filed: Jan. 29, 1980

[30] Foreign Application Priority Data

| | | | |
|---|---|---|---|
| Feb. 5, 1979 | [AU] | Australia | PD7563 |
| Mar. 15, 1979 | [AU] | Australia | PD8074 |
| Aug. 7, 1979 | [AU] | Australia | PD9920 |

[51] Int. Cl.[3] ..... B03B 5/52

[52] U.S. Cl. ..... 209/459; 209/493

[58] Field of Search ..... 209/211, 459, 493, 696, 209/697

[56] References Cited

U.S. PATENT DOCUMENTS

| | | | |
|---|---|---|---|
| 2,615,572 | 10/1952 | Hodge | 209/211 |
| 4,059,506 | 11/1977 | Bryson | 209/211 X |

*Primary Examiner*—Ralph J. Hill

*Attorney, Agent, or Firm*—D. Paul Weaver

[57] ABSTRACT

A spiral separator for the wet gravity separation of solids of different specific gravities has a number of helical sluices or spirals mounted about a vertical column, the bottom of each spiral being substantially straight in cross-section and inclining upwards from inside to outside of the spiral, the pitch of the outside of the spiral being substantially uniform, but the angle of the spiral bottom to horizontal, and therefore the pitch of the inside part of the spiral, varying, this angle and the inside pitch of the spiral being greater in the upper part of the spiral than in the lower part.

6 Claims, 6 Drawing Figures

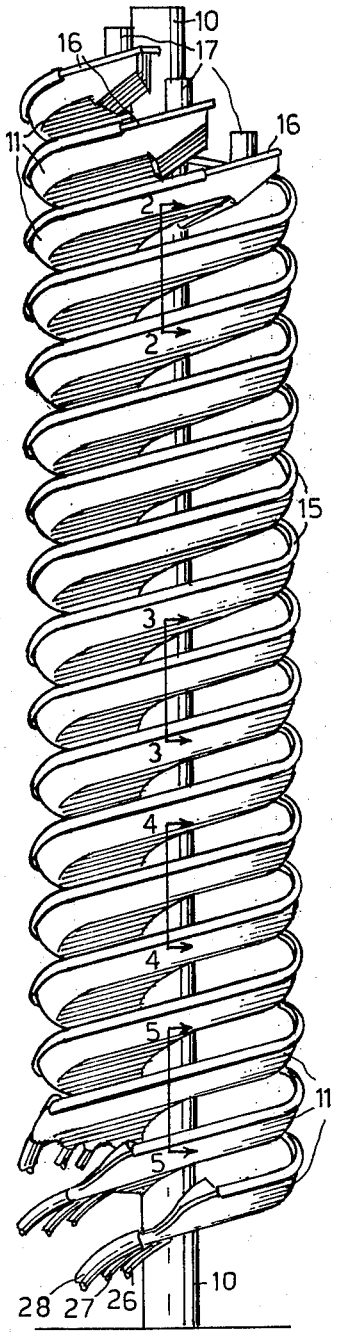
FIG. 1.
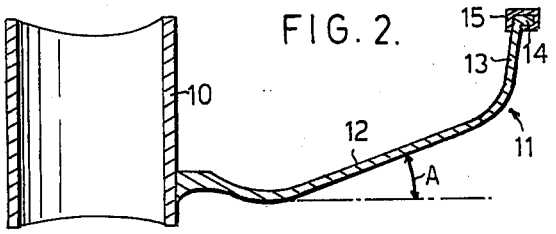
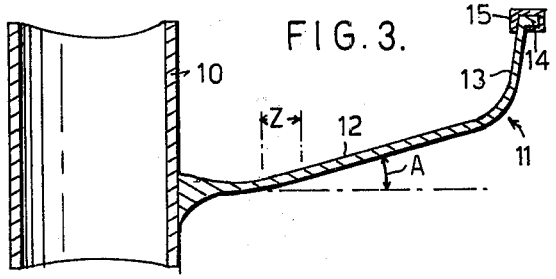
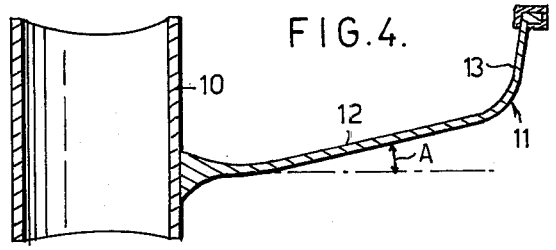
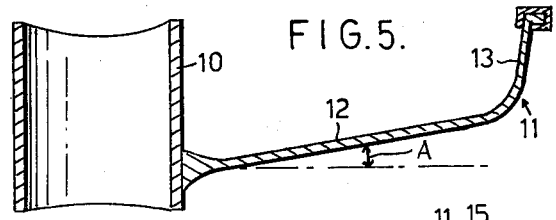
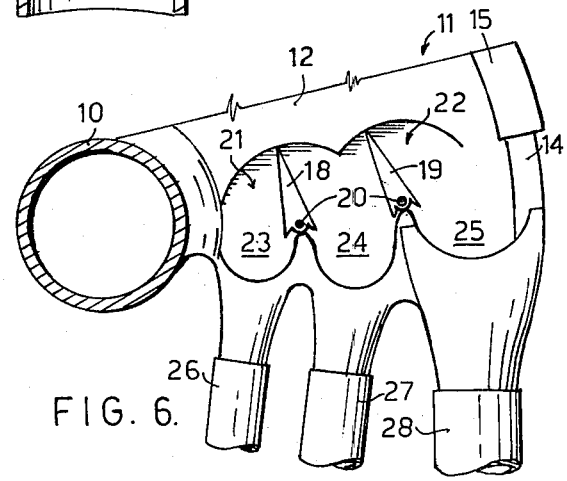
FIG. 6.

SPIRAL SEPARATORS

BACKGROUND OF THE INVENTION

This invention relates to an improved spiral separator.

Spiral separators are used extensively for the wet gravity separation of solids according to their specific gravities, for example in separating various kinds of mineral sands from silica sand, or in cleaning crushed coal by the removal of ash and other impurities.

A spiral separator consists usually of a vertical column about which there are supported a number, commonly two, of helical troughs or sluices, generally known as "spirals." The spirals are of constant or uniform pitch, corresponding parts of the spirals of a two-start spiral separator being diametrically opposed at the same level. A "pulp" or slurry of the materials to be separated and water, is fed at a predetermined rate into the upper ends of the spirals, and as the fluid mixture passes down through them it tends to form bands or strata of minerals of different specific gravities. These strata are separated at intervals by adjustable splitters, the mineral fractions which are required to be recovered, and which are thus separated, being carried away through take-off openings, wash water being introduced at intervals to the inside parts of the spirals to correct the pulp density and prevent "sand-barring" or the formation of stationary deposits of the material of lesser specific gravity on the bottom of the spirals.

A separator of this type is of fairly complex character, with its numerous adjustable splitters, which may require re-adjustment from time to time, and with the hoses connected to and leading down from the take-offs, and the hoses feeding wash water at intervals to each spiral, any of which hoses may become blocked by fibrous particles and require to be cleared. The separator, then, is expensive to manufacture, and requires fairly constant attention at a number of points to achieve acceptable results.

Normally, spiral separators of this type are used to separate the required materials by a number of successive and interrelated treatments. Thus, in the first pass, the material is divided into a heavy fraction or concentrate and a light fraction or tailings; the heavy fraction is re-treated to produce a concentrate and a tailing, which is combined for re-treatment with a heavier fraction split from the tailing of the first pass, and so on. At each stage, the volume of tailing which is thrown, or discarded, as containing only an insignificant amount of the mineral to be recovered, is not substantial. The repeated re-treatment of much of the pulp is, of course, slow and expensive.

The present invention has been devised with the general object of providing a spiral separator which, as well as being simple and ecomonical to manufacture and operate, may be used to produce a rich concentrate and throw a very substantial final tailing on a single pass of material through the apparatus, a middling cut being taken for re-treatment.

BRIEF SUMMARY OF THE INVENTION

With the foregoing and other objects in view, the invention resides broadly in a spiral separator of the type having a helical sluice or spiral supported with its axis substantially vertical, capable of receiving at its upper end a pulp of water and minerals to be separated and having dividing means for dividing strata of different densities from the flow and for withdrawing these separately, wherein the bottom of the spiral is, in cross-section, substantially straight and at an angle to horizontal, inclining upwardly from inside to outside, the pitch of the outside part of the spiral is substantially uniform, the pitch of the inside of the spiral varying, the angle of the spiral bottom to horizontal being greater in the upper part of the spiral than in the lower part. Other features of the invention will become apparent from the following description.

BRIEF DESCRIPTION OF THE DRAWINGS

A preferred embodiment of the invention is shown in the accompanying drawings, wherein:

FIG. 1 is a side elevational view of a spiral separator according to the invention, FIGS. 2, 3, 4 and 5 are cross-sectional views to larger scale of one of the spirals of the separator taken respectively, along lines 2—2, 3—3, 4—4 and 5—5 in FIG. 1, and FIG. 6 is a plan view of the bottom end of one of the spirals of the separator.

DETAILED DESCRIPTION OF THE PREFERRED EMBODIMENT

The separator shown in the drawings includes a central vertical tubular column 10. Three identical helical sluices or spirals 11, each of five complete turns, are mounted coaxially on the central column 10. Each of the spirals may be moulded as an integral unit, of fiberglass for example. Each spiral has a bottom 12 of which the greater part, in cross-section, is substantially straight, inclining upwards from the inside to the outside of the spiral at an angle A, as indicated in FIGS. 2, 3, 4 and 5. The inside part of the bottom, nearest the axis of the spiral, has a fairly short upward curve to meet the column 10, and the outside part of the bottom leads up through a small-radius curve to the nearly vertical outside wall 13 of the spiral. The outside wall 13 is formed, at the top, with an outwardly projecting rim 14, over which there is fitted closely and secured an extruded flexible cover strip 15 made of a suitable plastics material.

The pitch of the outside part of the spiral is uniform, but the cross-sectional angle A of the spiral bottom 12 to horizontal, and consequently the pitch of the inside part of the spiral, is varied. In the first two complete turns of each spiral, this angle A, as shown in FIG. 2, is about 21°. Below these two upper turns, the angle A of the spiral bottom to horizontal is reduced to about 15° in the third turn as shown in FIG. 3; is further reduced to about 12° in the fourth turn, as shown in FIG. 4, and is further reduced again to about 9° for the fifth and final turn of the spiral, as shown in FIG. 5. In each case, the reduction of the angle A is not abrupt but the change is made gradually, through about a third of a turn of the spiral.

The uppermost part of each of the spirals 11 is covered by a top plate 16, through which a tubular pulp inlet 17 leads to the top part of the spiral. The three spirals are so mounted on the central column 10 that the pulp inlets 17 are about as close as is practical, to facilitate the simultaneous feed of pulp to all three.

In the lowermost part of each of the spirals (FIG. 6) two splitter blades 18 and 19 are mounted on a pair of pins 20 secured to and extending upwardly from the spiral bottom 12. Each of these splitter blades may suitably be moulded of a plastics material, and in plan view is substantially of arrowhead form, with a sharp upright edge directed up-stream, the down-stream part of the splitter blade being apertured for a friction fit on its pin 20, so that the blade will remain in the position to which it is turned. The splitter blades 18 and 19 have their lower parts within adjacent substantially sector-shaped recesses 21 and 22 formed in the spiral bottom 12, the sharp up-stream edge of the blades 18 and 19 closely approaching the arcuate up-stream edges of the recesses. Down-stream of the splitter blades 18 and 19 the spiral bottom is shaped to form a concentrates channel 23, a middlings channel 24 and a tailings channel 25, the splitter blade 18 being arranged between the entries to the concentrates channel 23 and middlings channel 24, the splitter blade being arranged between the entries to the middlings channel 24 and the tailings channel 25. The three channels 23, 24 and 25 develop into tubular passages to which are connected, respectively, a concentrates hose 26, a middlings hose 27 and a tailings hose 28, each leading down to an appropriate receptacle (not shown).

In use, a pulp of water and solids to be separated into, for example, mineral sands and silica sands, is fed simultaneously into the pulp inlets 17 of the three spirals 11. Within the uppermost turns of the spirals, the mineral sands, of fairly high specific gravity, tend to move down across the steeply sloping bottom 12 of each of the spirals towards the central column 10, where the angle of descent is very steep, and at the same time, the less dense silica sands tend to move centrifugally outwards towards the outer wall 13 of the spiral. The reduction of the spiral bottom angle A, in the third turn of each spiral, exercises a braking effect on the flow of the material particularly on flow of the material near to the inside of the spiral, where the change in pitch and of the gradient of descent of the material is most pronounced. Consequently there is a spreading of the innermost stratum of the pulp which appears to facilitate the separation cut from this stratum of fine silica particles which otherwise are likely to remain locked into the flow of concentrated mineral sands. Between the innermost stratum of fairly concentrated mineral sands and the outer stratum mainly of silica sands there becomes apparent a zone which we call a "flick zone," indicated at Z in FIGS. 3, 4 and 5, and characterized by rapidly recurring outward surges of sand, more or less tangential to the innermost stratum of mainly high density mineral sand. It appears that a substantial amount of separation of the mineral and silica sands occurs in this flick zone, which with many materials is more shallow than the concentrate stratum inwardly of it, or the tailings stratum outwardly of it, the silica sand separating centrifugally outwards and generally above the inwardly moving denser mineral sands.

The flow of the pulp is further braked in the fourth turn of the spiral, with the reduction in the pitch of its inner part consequent in the further reduction of the angle A. The flick zone remains pronounced in appearance, but it moves outwardly, relative to the position it occupies in the third turn of the spiral, and the rapidly occurring outward surges are somewhat diminished in strength. With the further reduction in the pitch of the inside part of the spiral, which occurs in the fifth and final turn, and the resultant further deceleration of the innermost stratum of the material, the width of the space between the innermost stratum of concentrated mineral sands and the outermost stratum mainly of silica sands becomes wider, the distance of this zone from the axis of the spiral is further increased, and the apparent strength of the outward surges therein is further decreased.

The splitter blades are adjusted manually to make the required cuts in the still rapidly flowing pulp, to direct the concentrate stratum, containing mainly heavy minerals, to the concentrates channel 21 and hose 24, the middlings stratum, containing mainly silica sand but including also a significant proportion of the heavier mineral sands, into the middlings channel 22 and middlings hose 25, and the tailings stratum, containing no more than an insignificant quantity of the minerals sought to be recovered, into the tailings channel 23 and tailings hose 26.

It has been found that the setting of the splitter blades 18 and 19, on the bottoms of the recesses 21 and 22 with the lower parts of their sharpened up-stream edges close to the upstream edges of these recesses, greatly increases the efficiency of the splitters. If a splitter blade is, instead, set on a plain or un-recessed spiral bottom, and adjusted at an angle to the direction of flow of the pulp, then the pulp does not divide cleanly at the sharp edge of the blade, but divides instead at a main impact position some distance from the sharp edge, a proportion of the pulp reversing direction to flow back and around this edge. In the arrangement illustrated, however, the pulp divides against the sharpened edges of the splitter blades as it flows down into the recesses 21 and 22, and thus clean and accurate cuts are made by the splitter blades.

The long and uninterrupted flow of the pulp through each spiral undisturbed by splitters and take-offs and by any introduction of wash water, is found to be very conducive to the efficient gravity separation of the constituents of the pulp. The flat-bottomed configuration of each spiral and the reduction in the angle of the spiral bottom and the consequent development of the flick zone wherein the separation of denser and less dense materials is accelerated, are further very material contributions to the efficient mineral separation, with the overall result that the tailings, normally by far the major fraction of the pulp, will contain no significant proportion of the minerals required to be recovered, and may straightway be discarded; and the concentrate will be very rich in the denser minerals. The middlings only, then, are normally reserved for re-treatment.

The elimination from the spirals of hoses for the introduction at intervals of wash water, which is found to be unnecessary in spirals of the configuration according to the invention, and also the elimination of the series of splitters and take-offs hitherto normally provided at close intervals throughout the length of each spiral enables three spirals to be mounted about a central column instead of the two spirals of conventional separators. The floor area of a treatment plant using separators according to the invention may therefore be very materially reduced, and as fewer separators will be required for a given through-put of material, the roof height of the plant may also be reduced, since the length of gravity feed conduits from the separators may be greatly reduced.

Any adjustment which may from time to time be required to be made to the splitter blades of a separator according to the invention may be easily and quickly carried out, whereas the adjustment of series of splitters in conventional separators is difficult and time-consuming.

With certain materials which are very difficult to separate efficiently with conventional plant, spirals according to the invention may be modified to achieve optimum results, particularly by changing the bottom angles of the spiral. For example, the final or lowermost one, or two, reductions of the bottom angle A of the spiral may be eliminated, the angle A remaining constant in the lowermost two or three turns of the spirals.

We claim:

1. A spiral separator supported with its axis substantially vertical which is adapted to receive at an upper end thereof a pulp of water and minerals to be separated, said spiral separator including:

a plurality of helical turns wherein the bottom of each turn in cross section includes a substantially straight or flat portion and an outer portion, said straight portion being inclined at an angle to horizontal and said outer portion being inclined upwardly relative to the straight portion, characterized in that the angle to horizontal of the straight portion of each or adjacent groups of turns progressively decreases from top to bottom throughout at least a major part of the length of the spiral separator to thereby develop a braking effect on the flow of pulp which comprises heavy particles, light particles and intermediate size particles, whereby the flow of light particles throughout the said substantial part of the spiral separator is gradually shifted outwardly from the flow of heavy particles and intermediate size particles to facilitate subsequent separation of the light particles from said heavy and intermediate size particles; and dividing means for dividing said light particles from said heavy particles and intermediate particles and means for withdrawing said light particles from said heavy and intermediate size particles separately.

2. A spiral separator as claimed in claim 1 wherein each helical turn of the separator also includes an inner portion located inwardly of the straight portion and in which said heavy particles flow throughout the length of the spiral separator, there also being provided dividing means for dividing the heavy particles from the intermediate size particles and means for withdrawing said heavy particles and intermediate size particles separately.

3. A spiral separator as claimed in claim 1 or claim 2 wherein the starting point of the straight portion of each helical turn shifts progressively inwardly toward the longitudinal axis of the spiral separator from top to bottom throughout at least the major part of the length of the spiral separator.

4. A spiral separator as claimed in claim 3 wherein:

the dividing means consist of laterally adjustable splitters in the lower part only of the spiral and adapted to direct the innermost stratum of heavy particles flowing in each said inner portion to a concentrates or heavy particles channel, the outermost stratum flowing in each said straight portion to a tailings or light particles channel and an intermediate stratum of intermediate size particles flowing in each said straight portion but inwardly of the flow of light particles to a middlings or intermediate size particles channel.

5. A spiral separator as claimed in claim 2 wherein:

the dividing means consist of laterally adjustable splitters in the lower part only of the spiral and adapted to direct the innermost stratum of heavy particles flowing in each said inner portion to a concentrates or heavy particles channel, the outermost stratum flowing in each said straight portion to a tailings or light particles channel and an intermediate stratum of intermediate size particles flowing in each said straight portion but inwardly of the flow of light particles to a middlings or intermediate size particles channel.

6. A spiral separator according to claim 5 wherein:

each of the splitters is an upright blade pivoted at its downstream end and with a sharp edge at its upstream end, its lower part being within a recess in the spiral bottom, its sharp edge closely approaching the upstream end of the recess.

* * * * *